US008424557B1

(12) United States Patent
Russell

(10) Patent No.: US 8,424,557 B1
(45) Date of Patent: Apr. 23, 2013

(54) DOWNSPOUT WATER DIVERSION AND OVERFLOW DEVICE AND WATER COLLECTION AND OVERFLOW SYSTEM EMPLOYING THE SAME

(76) Inventor: Donald J. Russell, Amity, OR (US)

( * ) Notice: Subject to any disclaimer, the term of this patent is extended or adjusted under 35 U.S.C. 154(b) by 0 days.

(21) Appl. No.: 13/374,774

(22) Filed: Jan. 12, 2012

Related U.S. Application Data

(60) Provisional application No. 61/461,231, filed on Jan. 14, 2011.

(51) Int. Cl.
*E04D 13/08* (2006.01)

(52) U.S. Cl.
USPC ..... 137/357; 137/423; 137/429; 137/546; 137/550; 137/587; 52/16; 4/665

(58) Field of Classification Search ..... 137/357, 137/546, 550, 409, 423, 429, 434, 585, 583, 137/584, 587; 4/665; 52/11, 12, 16
See application file for complete search history.

(56) References Cited

U.S. PATENT DOCUMENTS

| | | | | |
|---|---|---|---|---|
| 4,726,151 | A * | 2/1988 | Vitale | 52/16 |
| 5,114,594 | A | 5/1992 | Rosebrock et al. | |
| 5,533,303 | A | 7/1996 | Harvey | |
| 5,730,179 | A | 3/1998 | Taylor | |
| 6,357,183 | B1 | 3/2002 | Smith | |
| 6,526,699 | B1 | 3/2003 | Foglio, Sr. | |
| 6,889,395 | B1 | 5/2005 | Hodges | |
| 6,941,702 | B1 | 9/2005 | Abrams et al. | |
| 6,966,333 | B1 | 11/2005 | Kuehneman | |
| 7,395,633 | B2 | 7/2008 | Baeta | |

* cited by examiner

*Primary Examiner* — Craig Schneider
(74) *Attorney, Agent, or Firm* — John R. Flanagan

(57) ABSTRACT

A downspout water collection and overflow system employs a downspout water diversion and overflow device which includes a body displacing a downspout section, and a plate supported in the body. The body, being hollow, has upper, lower and side portions defining top, bottom and side openings. The plate is inclined to extend laterally across the body between the upper and lower portions and through the side opening of the side portion. The plate blocks flow of water directly from the top to bottom opening of the body, diverting water flow through the side opening to a storage tank. The plate divides the side opening into upper and lower passages which allows inflow of water from the upper body portion through the upper passage above the plate to the tank and overflow of water from the tank through the lower passage below the plate to the lower body portion.

20 Claims, 3 Drawing Sheets

DOWNSPOUT WATER DIVERSION AND OVERFLOW DEVICE AND WATER COLLECTION AND OVERFLOW SYSTEM EMPLOYING THE SAME

This patent application claims the benefit of U.S. provisional application No. 61/461,231 filed Jan. 14, 2011. The disclosure of said provisional application is hereby incorporated herein by reference thereto.

BACKGROUND OF THE INVENTION

1. Field of the Invention

The present invention generally relates to sustainable water conservation practice and, more particularly, is concerned with a downspout water diversion and overflow device and a water collection and overflow system employing the device.

2. Description of the Prior Art

There is increasing interest by both water consumers and suppliers to use less water and use it more efficiently and sustainably. Water utility companies and city water departments emphasize conservation and encourage less use with education, suggestions, financial incentives, and even restrictions when shortages are forecast. In response to the growing need, devices have been disclosed that capture and collect free water, such as rainwater, in order to augment utility water sources and displace some of their cost. The collected free water may have exterior uses, such as for gardening, as well as interior uses, such as for toilet tanks and laundry.

Most designs involve a barrel connected to an eave gutter system and provided with an outlet for dispensing the stored water. These designs typically either lack broad application because they are too simple or they are too complex and difficult to install. The more complex designs typically require substantial modifications to the existing residential structure, to the plumbing or electricity configuration, or some combination thereof. Frequently, to handle the modifications and installation of the more complex devices, skills of professional plumbers, carpenters, or electricians are required. Most residential consumers, as well as incentive-bearing utility companies, shy away from these designs due to their attendant costs and difficulties.

Thus, innovation is needed to make capture, collection and utilization of free water more effective and affordable for residential consumers.

SUMMARY OF THE INVENTION

The present invention is directed to a downspout water collection and overflow system which satisfies the aforementioned need. The system of the present invention may be installed for use with an existing gutter downspout system on a building to collect water runoff from the roof of the building and store the collected water so as to make it available to dispense for other uses.

Accordingly, one aspect of the present invention is a downspout water diversion and overflow device which includes a body for displacing a section of an existing downspout and a plate supported in the body. The body is hollow and has upper, lower and side portions defining top, bottom and side openings such that the upper and lower portions align with remaining upper and lower sections of the existing downspout and the side portion extends laterally from the upper and lower portions and is adapted for establishing flow communication with a water storage tank. The plate is supported in the body to extend laterally across the body between the upper and lower portions thereof for blocking flow of water directly from the top opening to the bottom opening and instead diverting the water flow to the side opening of the body. The plate also is aligned with and extends through the side portion of the body so as to divide the side opening into upper and lower passages and respectively allow inflow of water from the upper portion of the hollow body through the upper passage above the plate to the storage tank and overflow of water from the storage tank through the lower passage below the plate to the lower portion of the hollow body.

Another aspect of the present invention is a downspout water collection and overflow system which includes a water storage tank and a downspout water diversion and overflow device. The storage tank for collecting, holding and dispensing water can be situated in proximity to the exterior of a building laterally offset from an existing downspout thereon. The downspout water diversion and overflow device displaces a section of the existing downspout. The device has a body being hollow and open at opposite ends and at a side of the body where the body is interconnectable to the storage tank. The device also has a plate supported in the body for blocking flow of water directly down the existing downspout through the open opposite ends of the body and instead diverting the water flow to the storage tank. The plate divides the body so as to define an upper passage above the plate through the body from an existing downspout section above the device to the open side of the body such that water is allowed to inflow through the upper passage above the plate to the storage tank and define a lower passage below the plate through the body from the open side of the body to an existing downspout section below the device such that water is allowed to overflow from the storage tank through the lower passage below the plate.

A further aspect of the present invention is a downspout water collection and overflow system which includes a water storage tank for collecting, holding and dispensing water and for situating in proximity to the exterior of a building laterally offset from an existing downspout thereon, a downspout water diversion and overflow device for displacing a section of the existing downspout, and a conduit connectable with the device and storage tank for enabling flow of water between the device and storage tank. The device has a body being hollow and a plate supported in the body for blocking flow of water directly down the existing downspout through the body and instead diverting the water flow from the body to the storage tank via the conduit. The plate divides the body so as to define an upper passage above the plate through the body from an existing downspout section above the device to the conduit such that water is allowed to inflow through the upper passage above the plate to the storage tank via the conduit and define a lower passage below the plate through the body from the conduit to an existing downspout section below the device such that water is allowed to overflow from the storage tank via the conduit through the lower passage below the plate.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Basic Downspout Water Collection and Overflow System—FIGS. 1-4

Figure 2:
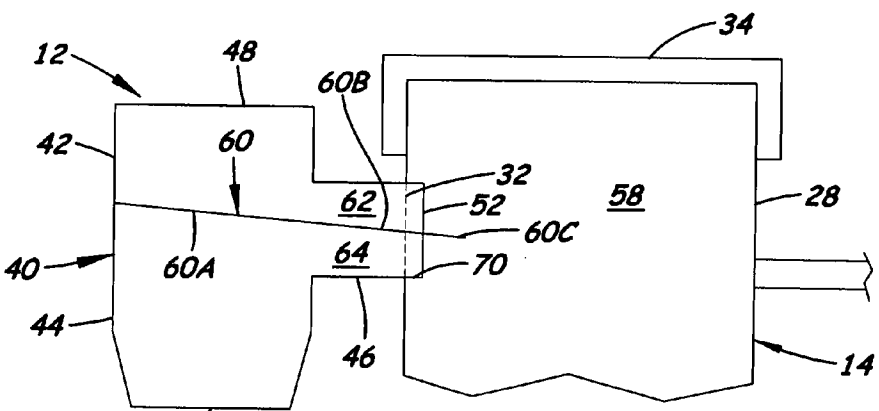
FIG. 2 is an enlarged fragmentary sectional view of a downspout water diversion and overflow device and an upper portion of a water storage tank of the system of FIG. 1.
Figure 3:
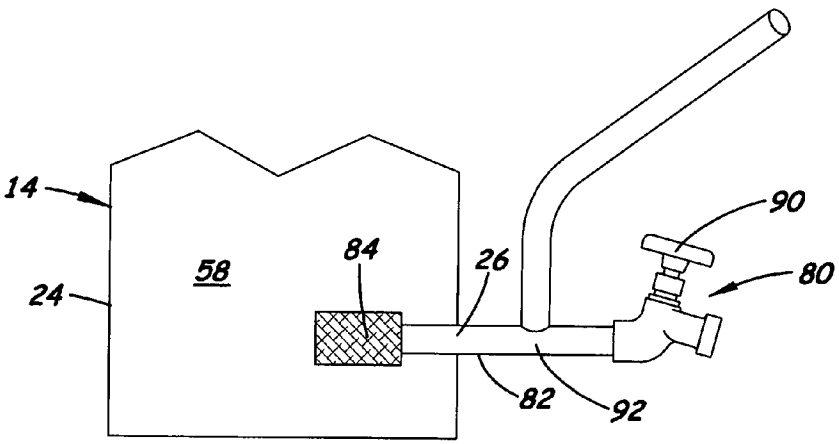
FIG. 3 is an enlarged fragmentary sectional view of a lower portion of the water storage tank of FIG. 1 and its associated water dispensation plumbing.
Figure 1:
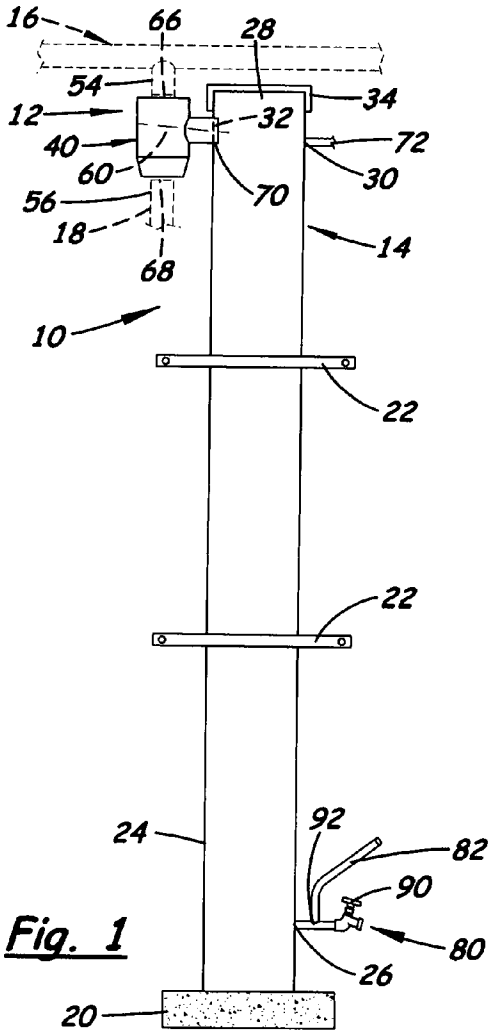
FIG. 1 is an elevational view of a basic embodiment of a downspout water collection and overflow system in accordance with the present invention.

Referring to the drawings, and particularly to FIGS. 1-3, there is illustrated a basic exemplary embodiment of a downspout water collection and overflow system, generally designated 10, in accordance with the present invention. The system 10 basically includes a downspout water diversion and overflow device 12, also in accordance with the present invention, and a water storage tank 14. The device 12 is constructed and situated for diverting water from an existing gutter downspout arrangement 16. The water storage tank 14 is constructed and situated for receiving water from the device 12 and holding or storing the water in the tank 14 for subsequent dispensing of the water therefrom. Thus, the system 10 may be installed for use with the existing gutter downspout arrangement 16 such as provided on a building (not shown) in order to collect free water runoff from the roof of the building and make it available to dispense for other uses, such as gardens and toilet tanks respectively exteriorly and interiorly of the building.

More particularly, the water storage tank 14 may be disposed in an upright orientation, situated in proximity to an exterior wall of the building, and offset laterally of a conventional downspout 18 of the gutter downspout arrangement 16. The storage tank 14 may be made from lightweight plastic or other suitable material. It may also be made into other suitable forms, though the tubular structure shown in FIG. 1, in resembling a large drain pipe, matches well with current downspout geometries. While illustrated in a generally vertical orientation, the storage tank 14 may be disposed in a different orientation relative to the building that is more desirable for a given application. The storage tank 14 also may be assembled from a plurality of sections (not shown) or may be installed in a substantially one-piece construction. A base or footing 20 may be desired for most installations for supporting the tank 14. Also, upper and lower restraining straps 22, made of, for example, metal, may be used to secure or anchor the storage tank 14 to the adjacent building.

Figure 5:
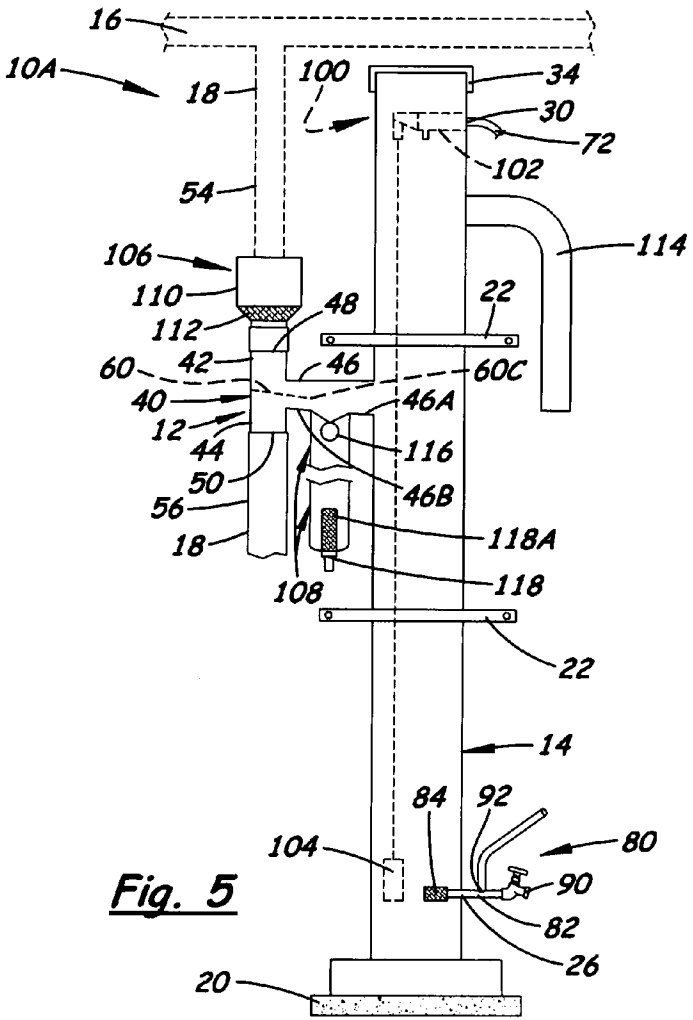
FIG. 5 is an elevational view of an enhanced embodiment of the downspout water collection and overflow system in accordance with the present invention.

The water storage tank 14 may also include a plurality of openings for handling water inflow and outflow. For example, nearer a lower portion 24, the storage tank 14 has a dispensation outlet 26 for dispensing water stored therein. Nearer the upper portion 28, the storage tank 14 has a replenishment inlet 30 for receiving replenish water to refill the storage tank 14. A water replenishment mechanism (such as shown in FIG. 5 but not shown in FIG. 2) may be located in the upper portion 28 of the tank 14 connected to the replenishment inlet 30. Also, nearer the upper portion 28, the storage tank 14 has a water side inlet 32 for allowing the inflow of water into the storage tank 14 and for overflow discharging of excess water from the storage tank 14. A cap 34 may cover the open top of the storage tank 14 to prevent foreign debris, vermin and insects, such as mosquitoes from entering the tank 14. The cap 34 may also be removed for tank cleaning purposes.

Referring still to FIGS. 1 and 2, the downspout water diversion and overflow device 12, also of the present invention, displaces a section of the existing downspout 18. The device 12 includes a body 40 being hollow and having a sideways T-shaped configuration formed by upper, lower, and side portions 42, 44, 46 which define top, bottom, and side openings 48, 50, 52 in the body 40. The upper and lower portions 42, 44 align with the remaining upstream and downstream portions 54, 56 of the existing downspout 18 so that the device 12 may be inserted therebetween in order to replace the displaced section of downspout 18. The side portion 46 extends laterally from the upper and lower portions 42, 44 into flow communication with the interior portion 58 of the upper portion 28 of the storage tank 14 via the water side inlet 32.

The device 12 also has a plate 60 stationarily disposed and supported in the body 40 in any suitable manner intermediate between the upper and lower portions 42, 44 thereof so as to block flow of water traveling from upstream to downstream portions 54, 56 of the downspout 18 directly from the top opening 48 to the bottom opening 50 of the device 12. The plate 60 is generally flat in configuration, although it may have other configurations, such as corrugations and the like. The plate 60 is mounted to the body 40 in a stationary position relative thereto and includes a first portion 60A disposed between the upper and lower portions 42, 44 of the body 40 and a second portion 60B disposed through the side portion 46 of the body 40. The plate 60, having a shape conforming to the cross-sectional shape of the body 40 through the side portion 46, may be disposed level although preferably it is disposed in an inclined orientation sloping downward from the first portion 60A to the second portion 60B thereof. As shown, the plate 60 is aligned with and slopes gradually downward through the side portion 46 of the body 40 into the upper portion 28 of the storage tank 14. By way of example and not as a limitation, the plate 60 can be disposed at an angle of inclination relative to a horizontal reference of between, for example, approximately one and fifteen degrees. The plate 60 divides the side opening 52 of the side portion 46 of the body 40 and defines upper and lower passages 62, 64 through the side portion 46 respectively above and below the plate 60.

The upper passage 62 allows the inflow of water to the interior portion 58 of the storage tank 14 through the water side inlet 32 from the upper portion 42 of the body 40 of the device 12 above the plate 60. The upper portion 42 of the body 40 couples (via an intervening air gap) to the lower end 66 of the upstream portion 54 of the downspout 18 and receives water flowing from the upstream portion 54 of the downspout 18 through the top opening 48 of the device 12. From the upper portion 42, the water then flows down onto the plate 60 and laterally through the upper passage 62 and the water side inlet 32 past the inner edge 60C of the plate 60 to the interior portion 58 of the storage tank 14.

The lower passage 64 allows the overflow of excess water from the interior portion 58 of the storage tank 14 through the water side inlet 32 to the lower portion 44 of the body 40 below the plate 60. The lower portion 44 of the body 40 couples to the upper end 68 of the downstream portion 56 of the downspout 18 and receives excess water from the interior portion 58 of the storage tank 14. When the water level in the interior portion 58 of the storage tank 14 rises above a bottom surface 70 of the side portion 46 of the device body 40, the excess water overflows out through the water side inlet 32 and the lower passage 64 to the lower portion 44 and through bottom opening 50 of the device 12 where the excess water can now discharge into the downstream portion 56 of the downspout 18 below the device 12. It will be observed that the storage tank 14 and device 12, constructed as described hereinabove, have no moving parts.

Figure 4:
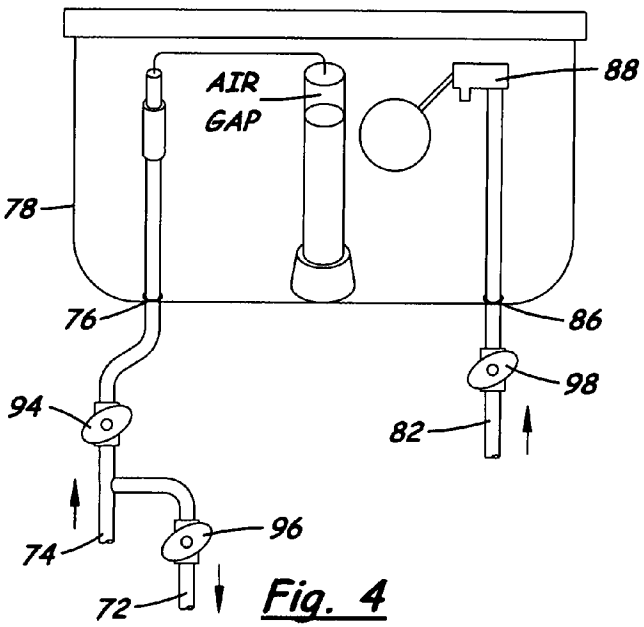
FIG. 4 is a schematic view of a toilet tank and associated plumbing connected with the system of the present invention.

Referring now to FIGS. 1, 3 and 4, the system 10 of the present invention may also include a replenishment conduit 72 attached at a first end to the replenishment inlet 30 of the storage tank 14, as shown in FIG. 1. The conduit 72 may also be attached at second end to a water source 74, as shown in FIG. 4, such as the one normally connected to an original toilet tank water inlet 76 under a toilet tank 78. The system 10 may also include a dispensation assembly 80, as shown in FIG. 3, which may be operably connected to the dispensation outlet 26 of the storage tank 14. The assembly 80 includes dispensation conduit 82 having a first end supporting a filter 84 and connected to the dispensation outlet 26 and a second end, as seen in FIG. 4, which may be attached to an inlet 86 on the toilet tank 78 leading to a water fill valve 88 in the toilet tank 78. The toilet tank 78 may be supplied and refilled in such manner with water coming from the storage tank 14. The dispensation assembly 80 may also have an exterior garden or outside faucet 90 attached at a split 92 in the dispensation conduit 82 outside the storage tank 14. The faucet 90 may be used for exterior purposes such as irrigation and the like such as in conjunction with an electric pump to deliver water and/or chemical and/or chlorine treatment and/or UV light treatment.

In order to connect the system 10 to a conventional toilet tank 78, a series of steps may be taken. The storage tank 14 is installed in proximity to the downspout 18, and the water diversion and overflow device 12 should be installed in the place of a displaced section of the downspout 18 and connected to the storage tank 14. Two holes (not shown) may be drilled near the toilet tank 78 that allow access to the exterior of the building. A section of the replenishment hose 72 and dispensation conduit 82 are flexibly fed through the respective holes from the exterior to the interior of the building. A water source valve 94 on the water source 74 that is feeding the original toilet tank water inlet 76 under a toilet tank 78 is turned off. The end of the replenishment hose 72 that is now on the interior of the building and in proximity to the toilet tank 78 is then connected to the water source 74 via an opened shut-off valve 96. The end of the dispensation conduit 82 that is also now on the interior of the building and in proximity to the toilet tank 78 is then connected to the other inlet 86 of the toilet tank 78 to the water fill valve 88 provided therein. Another shut-off valve 98 may be provided on the conduit 82 which is open during normal use but may be shut off to facilitate repairs and the like. Additional components (not shown) may include a backflow prevention unit and a water filtration and/or chlorination unit.

Figure 7:
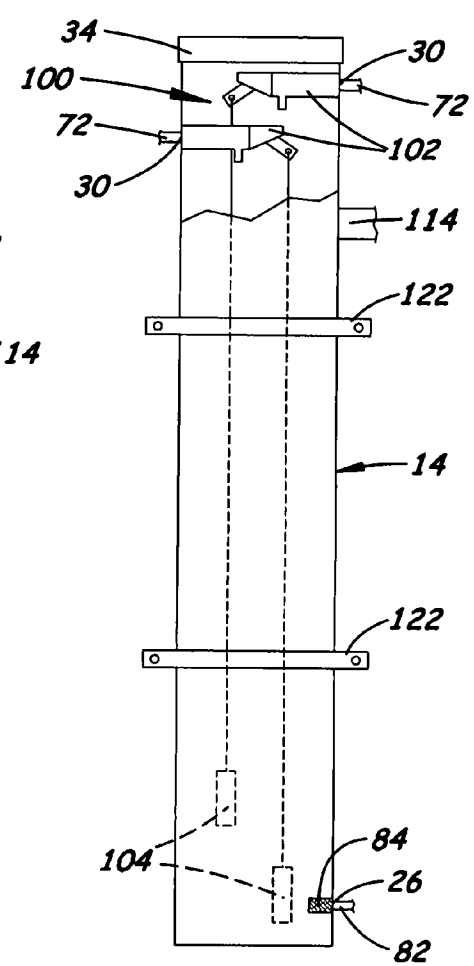
FIG. 7 is an elevational view of an alternative water storage tank for use with the enhanced embodiment of the system of FIG. 6.
Figure 6:
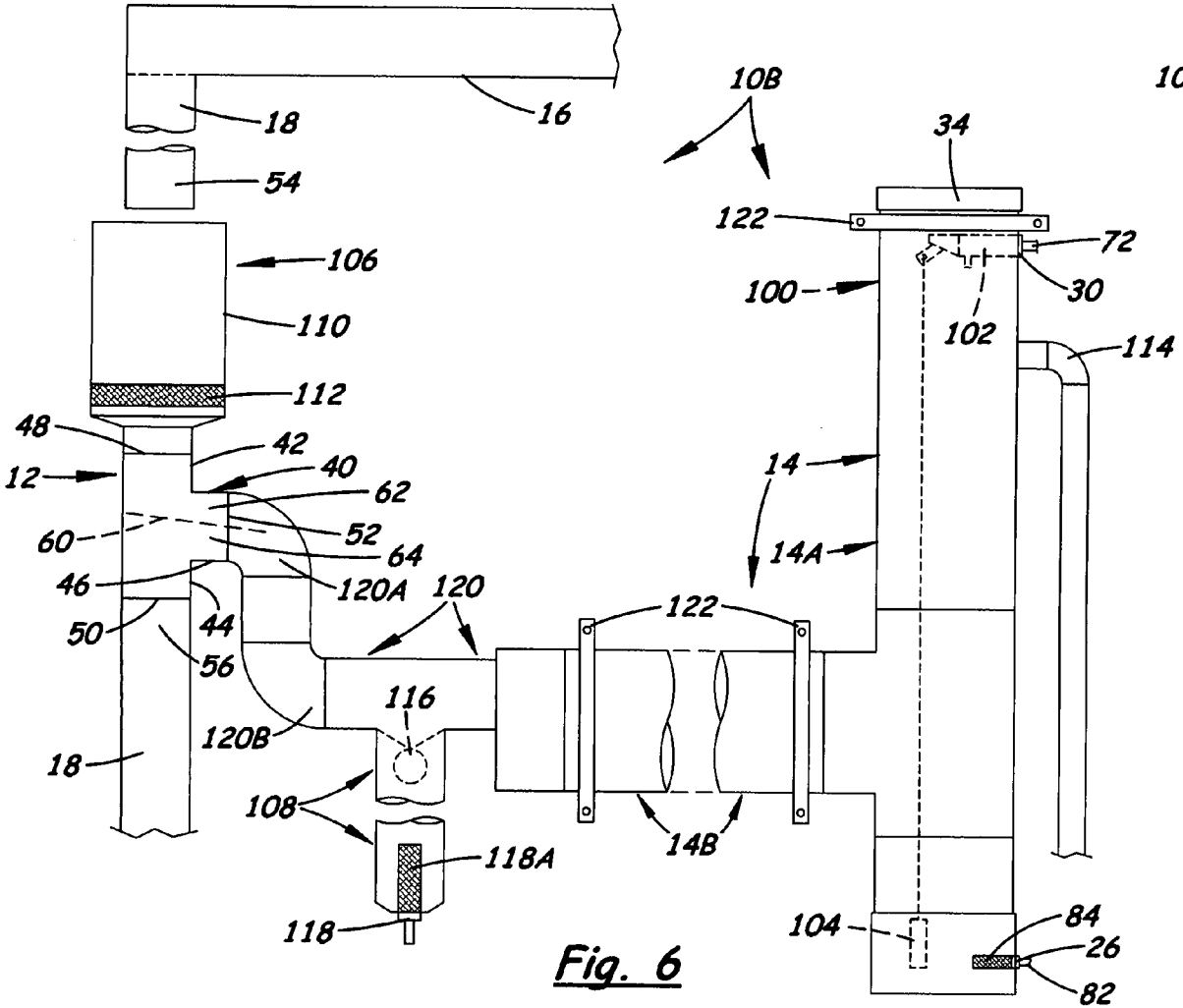
FIG. 6 is an elevational view of a further enhanced embodiment of the downspout water collection and overflow system in accordance with the present invention.

System Enhancements—FIGS. 5-7

Turning now to FIG. 5, there is shown an enhanced embodiment of the downspout water collection and overflow system, generally designated 10A, having the downspout diversion and overflow device 12 and water storage tank 14 as described previously with regard to the basic system 10 of FIGS. 1-3. Thus, the same reference numbers in FIGS. 1-3 and 5 designate the same components described previously and so description thereof need not be repeated. As pointed out previously, one component which is used but not shown in the basic system 10 in FIGS. 1-3 is a water replenishment mechanism 100 in the enhanced system 10A, as shown in FIG. 5. The replenishment mechanism 100 includes a valve 102 coupled to the replenishment conduit 72 at the water replenishment inlet 30 in the tank 14. The valve 102 is actuatable for opening and closing the replenishment inlet 30. The water replenishment mechanism 100 also includes a float member 104 in the water in the storage tank 14 and coupled to the valve 102 so as to actuate the valve 102 to open the inlet 30 and allow water inflow to the storage tank 14 when the level of water in the storage tank 14 falls below a first level and close the inlet 30 and halt water inflow to the storage tank 14 when the water reaches or rises above a second level higher than the first level.

Additionally, the enhanced system 10A, as shown in FIG. 5, also includes a foreign matter filter 106 disposed above the device 12 and a foreign matter collection chamber 108 disposed between the device 12 and the storage tank 14 to substantially prevent foreign matter from flowing into the storage tank 14. The filter 106 includes a holder 110 of tubular configuration with a removable filter screen 112 mounted across the hollow interior of the holder 110 at its bottom. The holder 110 is provided between the top opening 48 of the upper portion 42 of the device 12 and the upstream portion 54 of the existing downspout 18 so as to position the filter screen 112 lower than an air gap provided by an overflow pipe 114 on the tank 14. The filter screen 112 extends across the downward flow path of rainwater from the upper portion 54 of the downspout 18 so that it can intercept and prevent passage of debris above a given size into the device 12. It is desirable to maintain the device 12 and storage tank 14 free of debris in order to prevent clogging of various inlets and outlets thereof and also to avoid the accumulation of habitat therein that would provide an opportunity for insects, such as mosquitoes, to breed.

The foreign matter collection chamber 108 is located downstream of the discharge end portion 60C of the plate 60 of the device 12. The side portion 46 of the device body 40 is extended to accommodate the presence of the chamber 108 below it so as to enable collection of foreign matter, such as dust, bird droppings, chemicals, etc, that may accumulate on the roof between rain events and then wash off the roof at the start of each new rain event. A float ball 116 is installed at the top of the chamber 108 below a top opening thereto and a slow drip valve 118 (with a filter 118A) is installed at a bottom of the chamber 108 to foster a slight downward flow of the water in the chamber 108 and thereby a settling of such foreign matter in the chamber 100, enabling the flushing of it from the chamber 108, and consequently the prevention of it flowing into the storage tank 14. It should be noted that a lower inner edge 46A of the side portion 46 of the device body 40 is at a lower level than a lower outer edge 46B thereof. This will ensure that the chamber 108 as it fills with water will overflow into the storage tank 14, and not flow into the lower portion 44 of the device 12, until the storage tank 14 reaches the overflow stage. The capacity of the chamber 108 need only be a few gallons for it to serve its intended purpose. It can be lengthened or enlarged to accommodate local conditions.

Referring now to FIG. 6, there is shown a further enhanced embodiment of the downspout water collection and overflow system, generally designated 10B, having the downspout diversion and overflow device 12 and the water storage tank 14 as described previously with regard to the basic system 10 of FIGS. 1-3, and the water replenishment mechanism 100, the foreign matter filter 106 and the foreign matter collection chamber 108 as described previously with regard to the enhanced system 10A of FIG. 5. Thus, the same reference numbers in FIGS. 1-3, 5 and 6 designate the same components described previously and so description thereof need not be repeated. The system 10B is intended to be wall-mounted although it is not so limited. To expand its water storage volume, the system 10B now includes an enhanced multi-compartmented storage tank 14 and a conduit 120 between the device 12 and the storage tank 14. FIG. 7 shows an alternative water storage tank 14 for use in the enhanced embodiment of the system 10B of FIG. 6 having two water replenishment mechanisms 100 supplied by separate water replenishment sources, such as from a well in addition to the rainwater from the building roof and domestic water source. As shown, the valves 102 use different heights of their respective float members 104.

The collection chamber 108 in the system 10B of FIG. 6 is disposed in a somewhat different location from that in the system 10A of FIG. 5. More particularly, in the system 10B of FIG. 6 the collection chamber 108 is disposed between the device 12 and the storage tank 14 and connected with the conduit 120 for collecting foreign matter from water inflow via the conduit 120 from the device 12 so as to substantially prevent such foreign matter from flowing into the storage tank 14. The chamber 108 has the float ball 116 at its top and the slow drip valve 118 at its bottom as described previously.

Should more water storage be desired, auxiliary storage tanks may be added and connected to the original storage tank 14. The storage tank 14 also may be disposed in a different orientation relative to the building that is more desirable for a given application. The storage tank 14 also may be assembled from a plurality of sections (not shown) or may be installed in a substantially one-piece construction. For example, as mentioned above the storage tank 14 may be multi-compartmented to include a first portion 14A arranged in a substantially vertical orientation and a second portion 14B arranged in a substantially horizontal orientation and connected to the first portion 14A at a lower half thereof and connected to the conduit 120. For most installations, the first or vertical portion 14A and second or horizontal portion 14B of the storage tank 14 may be secured or anchored to the building by restraining straps 122. The conduit 120 may include a pair of ells or L-shaped sections 120A, 120B connected in a reverse relationship to one another such that the device 12 is disposed above the second portion 14B of the storage tank 14. The device 12 will divert all of the water received from the gutter downspout arrangement 16 until the water level rises and overflows into the portion of the upper L-shaped section 120A which is at the same height as the bottom of the side portion 46 of the body 40 of the device 12.

System Advantages & Benefits

The above-described embodiments of the systems are simple, affordable and easy to understand, install and maintain by an average person who knows how to use basic tools, such as an electric drill, crescent wrench, tin snips or saw and change a toilet float and flexible water line to a toilet tank. It can be shipped in one-piece or easily assembled sections that are lightweight and can be installed by a novice on site. The system 10 does not distract from the building's appearance. The systems, being tall, round and narrow in configuration, resembles a large drain pipe and can also be painted to match the building's exterior, making it blend into the background like most utilities attached to the building. By way of example but not limitation, the first (vertical) portion 14A of the tank 14 may be three to four feet in height and eight to fifteen inches in diameter; the second (horizontal) portion 14B of the tank 14 may be eight to ten feet in length and eight to fifteen inches in diameter.

The systems have essentially no moving parts except a standard floatation valve found in any typical household toilet tank and the float valves in the storage tanks, all of which are easy to replace. The systems work effectively off of gravity but can also accommodate use of a pump. There is no need for the services of an electrician, there being no electrical connections or electronic components to install, wire, adjust or break in the future. Further, there is no need for a carpenter, since nothing needs to be built or altered to accommodate the system 10. There is only minimal wall penetration in that one needs to drill two holes in the building between the existing downspout to the base of the toilet where the existing water line feeds into the toilet and run two flexible tubes to the toilet base. There is no need for a plumber either. The various components and materials of the systems can be handled with minimal plumbing skills, standard parts and do not require proprietary or special tools. Making the connection to the downspout only involves cutting and removing a small section of the existing downspout and inserting a preassembled downspout adapter, namely, the device 12. The systems require minimal maintenance but if needed, they are designed for easy disassembly, repair and reassembly. The system capacity is readily expandable by adding auxiliary tank components of various dimensions with a simple connection to the original tank components. Last, but not least, the systems serve the desire of using rain water to satisfy conservation goals.

It is thought that the present invention and its advantages will be understood from the foregoing description and it will be apparent that various changes may be made thereto without departing from the spirit and scope of the invention or sacrificing all of its material advantages, the forms hereinbefore described being merely exemplary embodiments thereof.

What is claimed is:

1. A downspout water diversion and overflow device, comprising:

a body for displacing a section of an existing downspout, said body being hollow and having upper, lower and side portions defining top, bottom and side openings such that said upper and lower portions align with remaining upper and lower sections of the existing downspout and said side portion extends laterally from said upper and lower portions and is adapted for establishing flow communication with a water storage tank; and a plate supported in said body to extend laterally across said body between said upper and lower portions thereof for blocking flow of water directly from said top opening to said bottom opening and instead diverting the water flow to said side opening of said body, said plate also aligned with and extending through said side portion of said hollow body so as to divide said side opening into upper and lower passages and respectively allow inflow of water from said upper portion of said body through said upper passage above said plate to the storage tank and overflow of water from the storage tank through said lower passage below said plate to said lower portion of said body.

2. The device of claim 1 wherein:

said upper and lower portions of said body are substantially aligned with one another; and said plate is mounted to said body in a stationary position relative thereto and includes a first portion disposed between said upper and lower portions of said body, and a second portion disposed through said side portion of said body such that said plate is disposed in an inclined orientation sloping downward from said first portion thereof to said second portion thereof.

3. The device of claim 2 wherein said plate is disposed at an angle of inclination relative to a horizontal reference of between approximately one and fifteen degrees.

4. A downspout water collection and overflow system, comprising a water storage tank for collecting, holding and dispensing water and for situating in proximity to the exterior of a building laterally offset from an existing downspout thereon; and a downspout water diversion and overflow device for displacing a section of the existing downspout, said device including a body being hollow and open at opposite ends and at a side where said body is interconnectable to said storage tank, and a plate supported in said body for blocking flow of water directly down the existing downspout through the open opposite ends of said body and instead diverting the water flow to said storage tank, said plate dividing said body so as to define an upper passage above said plate through said body from an existing downspout section above said device to said open side of said body such that water is allowed to inflow through said upper passage above said plate to said storage tank, and a lower passage below said plate through said body from said open side of said body to an existing downspout section below said device such that water is allowed to overflow from said storage tank through said lower passage below said plate.

5. The system of claim 4 wherein said storage tank includes:

a water dispensation outlet;

at least one water replenishment inlet; and a water side inlet adjacent and in flow communication with said open side of said body of said device.

6. The system of claim 5 further comprising:

a water replenishment mechanism mounted in said storage tank, said mechanism including a valve coupled to said water replenishment inlet and being actuatable for opening and closing said inlet, and a float member in said storage tank and coupled to said valve so as to actuate said valve to open said inlet and allow water inflow to said storage tank when the level of water in said storage tank falls below a first level and close said inlet and halt water inflow to said storage tank when the water reaches or rises above a second level higher than the first level.

7. The system of claim 4 wherein said body includes:

upper and lower portions defining said open opposite ends of said body and being substantially aligned with one another and with the remaining downspout; and a side portion defining said open side of said body and extending laterally from said upper and lower portions to said storage tank.

8. The system of claim 7 wherein said plate is mounted to said body in a stationary position relative thereto and includes:

a first portion disposed between said upper and lower portions of said body; and a second portion disposed through said side portion of said body such that said plate is disposed in an inclined orientation sloping downward from said first portion thereof to said second portion thereof.

9. The system of claim 8 wherein said plate is disposed at an angle of inclination relative to a horizontal reference of between approximately one and fifteen degrees.

10. The system of claim 4 further comprising:

a chamber disposable between and interconnectable with said body and said storage tank for collecting foreign matter from water inflow from said body so as to substantially prevent such foreign matter from flowing into said storage tank.

11. The system of claim 10 further comprising:

a slow drip valve in a bottom of said chamber to enable a settling of such foreign matter in said chamber and flushing thereof from said chamber.

12. A downspout water collection and overflow system, comprising:

a water storage tank for collecting, holding and dispensing water and for situating in proximity to the exterior of a building laterally offset from an existing downspout thereon;

a downspout water diversion and overflow device for displacing a section of the existing downspout; and a conduit connectable with said device and said storage tank for enabling flow of water between said device and said storage tank;

wherein said device includes a body being hollow and open at opposite ends and at a side where said body is connectable to said conduit, and a plate supported in said body for blocking flow of water directly down the existing downspout through said body and instead diverting the water flow from said body to said storage tank via said conduit, said plate dividing said body so as to define an upper passage above said plate through said body from an existing downspout section above said device to said conduit such that water is allowed to inflow through said upper passage above said plate to said storage tank via the conduit, and a lower passage below said plate through said body from said conduit to an existing downspout section below said device such that water is allowed to overflow from said storage tank via said conduit through said lower passage below said plate.

13. The system of claim 12 wherein said storage tank includes:

a water dispensation outlet;

at least one water replenishment inlet; and a water side inlet adjacent and in flow communication with said open side of said body of said device.

14. The system of claim 13 further comprising:

a water replenishment mechanism mounted in said storage tank, said mechanism including a valve coupled to said water replenishment inlet and being actuatable for opening and closing said inlet, and a float member in said storage tank and coupled to said valve so as to actuate said valve to open said inlet and allow water inflow to said storage tank when the level of water in said storage tank falls below a first level and close said inlet and halt water inflow to said storage tank when the water reaches or rises above a second level higher than the first level.

15. The system of claim 12 wherein:

said body includes upper and lower portions defining said open opposite ends of said body and being substantially aligned with one another and with the remaining downspout, and a side portion defining said open side of said body and extending laterally from said upper and lower portions to said storage tank; and said plate is mounted to said body in a stationary position relative thereto and includes a first portion disposed between said upper and lower portions of said body; and a second portion disposed through said side portion of said body such that said plate is disposed in an inclined orientation sloping downward from said first portion thereof to said second portion thereof.

16. The system of claim 15 wherein said plate is disposed at an angle of inclination relative to a horizontal reference of between approximately one and fifteen degrees.

17. The system of claim 12 further comprising:

a chamber disposable between said device and said storage tank and connected with said conduit for collecting foreign matter from water inflow via said conduit from said device so as to substantially prevent such foreign matter from flowing into said storage tank.

18. The system of claim 17 further comprising:

a slow drip valve in a bottom of said chamber to enable a settling of such foreign matter in said chamber and flushing thereof from said chamber.

19. The system of claim 17 wherein said storage tank includes a first portion arranged in a substantially vertical orientation and a second portion arranged in a substantially horizontal orientation and connected to said first portion at a lower half thereof and connectable to said conduit.

20. The system of claim 19 wherein said conduit includes a pair of L-shaped sections connected in a reverse relationship to one another such that said device is disposed above said second portion of said storage tank.

* * * * *